US007059814B2

(12) United States Patent
Su et al.

(10) Patent No.: US 7,059,814 B2
(45) Date of Patent: Jun. 13, 2006

(54) TRAILER SYSTEM FOR RADIATION IMAGING

(75) Inventors: Jianjun Su, Beijing (CN); Jianmin Li, Beijing (CN); Wanquan Shen, Beijing (CN); Shangmin Sun, Beijing (CN); Jianxin Wang, Beijing (CN)

(73) Assignees: Nuctech Company Limited, Beijing (CN); Tsinghua University, Beijing (CN)

( * ) Notice: Subject to any disclaimer, the term of this patent is extended or adjusted under 35 U.S.C. 154(b) by 0 days.

(21) Appl. No.: 10/955,773

(22) Filed: Sep. 30, 2004

(65) Prior Publication Data

US 2005/0084357 A1 Apr. 21, 2005

(30) Foreign Application Priority Data

Oct. 16, 2003 (CN) ..... 2003 1 01001836

(51) Int. Cl.
*B60P 7/08* (2006.01)

(52) U.S. Cl. ..... 410/65; 410/7; 410/19; 410/30; 410/46; 410/56; 410/67

(58) Field of Classification Search ..... 410/65, 410/7, 19, 30, 45, 56–57, 67; 414/222, 571; 105/355, 362

See application file for complete search history.

(56) References Cited

U.S. PATENT DOCUMENTS 4,231,695 A * 11/1980 Weston, Sr. ..... 410/69
4,609,313 A * 9/1986 Oshino et al. ..... 410/67
4,942,828 A * 7/1990 Walz et al.
6,837,657 B1 1/2005 Li et al. ..... 410/65

OTHER PUBLICATIONS

Webpage, Rapiscan Security Products "Cargo Systems Overview" 1999-2002.

* cited by examiner

*Primary Examiner*—Stephen Gordon
(74) *Attorney, Agent, or Firm*—Westman, Champlin & Kelly, P.A.

(57) ABSTRACT

A trailer system for radiation imaging, comprising a trailer including a frame, a plurality of guide wheels and connecting hooks, and anchoring devices, the frame comprises an intermediate section in the form of a H-shaped frame beam, a left frame bed and a right frame bed are connected to hinge shafts provided on four corner portions of the H-shaped frame beam, a positioning recess is provided centrally in an upper surface of each left and right frame beds, a wheel-catching means is provided at a rear end of each positioning recess, an upslope and a downslope daises are provided on a front end and a rear end of each of the left and the right frame beds, a support plate is provided at an outside end of each of the left and right frame beds, and a striking block is provided centrally at an outside of each support plate. The present invention requires low installation accuracy of the rails, and employs simultaneously moveable upslope and downslope daises convenient for mounting and using, thus increasing reliability, stability and practicability of the trailer.

7 Claims, 4 Drawing Sheets

TRAILER SYSTEM FOR RADIATION IMAGING

TECHNICAL FIELD

The present invention relates to a technology of radiation imaging for inspection, and more particularly, to a trailer system for carrying a vehicle to be inspected during radiation imaging.

BACKGROUND ART

Radiation-imaging inspection system is a necessary facility for the custom, the airport for civil aviation, and railway system. The radiation-imaging inspection system includes a fixed radiation source and an array detector which can receive radioactive rays passing through the vehicle to be inspected, the fixed radiation source and the array-detector are arranged in an inspection passage capable of shielding radioactive rays. The inspection system needs a special trailing unit so as to move a vehicle carrying containers to be inspected through the radioactive rays. The radioactive rays passed through the containers are transmitted to the array detector, the array detector then reflects the density distribution of the objects loaded in the containers based on variations of intensity of the radioactive rays, thus obtaining a perspective view of the objects loaded in the containers by converting intensity of the radioactive rays into gradation of image.

In the prior art, the above special trailing unit mainly employs a flat bed trailer or a plate-chain conveyer, for example, the No. 2000 type containerized cargo/vehicle inspection system manufactured by Rapiscan Company (US) employs a flat bed trailer, in which the truck carrying containers is driven onto the flat bed trailer and the flat bed trailer carrying the truck is then passed through the radioactive rays. The flat bed trailer occupies a large area of land and is high in manufacture cost. In addition, the flat bed trailer can not stably run and locate fixedly and reliably the vehicle to be inspected thereon, thus causing the image poor quality. Further, it is not convenient for the vehicle to be driven onto the flat bed trailer because the flat bed trailer is high relative to the ground. With the plate-chain conveyer, polygon-effect occurring therein shall cause deteriorated image and high noise.

In order to solve the above problems in the prior art, the present applicant filed a patent application CN1500685A, entitled "a trailer of an automatically scanning-type radiation inspection system for large-sized object", on Nov. 15, 2002 to the Chinese Intellectual Property Office, the trailer has low noise, occupies less land and is low in manufacture cost. In addition, the stability of the trailer is increased, the height of the trailer body is decreased, therefore, it is convenient for the vehicle to be driven onto the trailer. Moreover, there are additionally provided with means for locating the wheels of the vehicle and for anchoring the trailer. However, the main frame of the above trailer is manufactured by fixing steel plates integrally, and a plurality pairs of guide wheels are mounted under the integral main frame, in order to avoid the torque generated during running of the guide wheels on the rails, the rails should be arranged accurately, in addition, the slope daises are fixedly connected to the trailer body, so that it is inconvenient for the trailer to be mounted and used, and adaptability of the system is poor. Further, anchoring of the trailer is achieved by engagement of anchoring hooks provided on the trailer with wedges fixed on the ground, so that reliability, stability and practicability are poor.

SUMMARY OF THE INVENTION

In view of the above problems, an object of the present invention is to provide a trailer system for radiation imaging, the trailer system requires low installation accuracy of the rails, at the same time, employs moveable upslope and downslope daises which are convenient for mounting and using, therefore, reliability, stability and practicability of the trailer are improved.

The above object of the present invention is accomplished by providing a trailer system for radiation imaging, comprising: a trailer, the trailer including a frame, a plurality pairs of guide wheels connected to a bottom surface of the frame and capable of being supported and run on rails, and connecting hooks provided centrally on bottom portions of a front end and a rear end of the frame respectively; and anchoring devices fixed to a foundation ground and used in cooperation with the trailer so as to lock the trailer at predetermined positions in use; the frame comprises an intermediate section in the form of a H-shaped frame beam, a left frame bed and a right frame bed, the left frame bed and the right frame bed are connected to the intermediate section respectively, hinge shafts are provided on four corner portions of the H-shaped frame beam and hinged to the left frame bed and the right frame bed respectively, the left frame bed and the right frame bed are symmetrical with respect to a longitudinal central axis of the intermediate section, a positioning recess adapted to a lower portion of wheels of a vehicle to be inspected is provided centrally in an upper surface of each of the left frame bed and the right frame bed, a wheel-catching means is provided at a rear end of each the positioning recess for preventing the vehicle to be inspected from moving backwards on the trailer during movement of the trailer, an upslope-dais and a downslope dais are provided on a front end and a rear end of each of the left frame bed and the right frame bed respectively, so that the vehicle to be inspected can move onto or leave the trailer smoothly and stably through the upslope dais and the downslope dais, a support plate is provided at an outside end of each of the left frame bed and the right frame bed, and a striking block is provided centrally at an outside of each of the support plates and used in cooperation with the anchoring device fixed on the foundation ground so as to lock the trailer.

Further, each of the left frame bed and the right frame bed is constituted of a bottom plate, a pressing plate and rib plates, the guide wheels are connected to an inside surface of each of the left frame bed and the right frame bed, a plurality of auxiliary wheels are arranged under the support plate at an outside end of each of the left frame bed and the right frame bed, the bottom plate and the pressing plate are connected by the rib plates arranged vertically therebetween for reinforcing strength.

Preferably, the wheel-catching means is consisted of a crank member which can be pressed so as to be horizontal and be embedded in the pressing plate and a spring, the crank member is hinged to a side plate of one rib plate at the rear end of each the positioning recess, the spring is fixed to the crank member and one rib plate at both ends thereof respectively, an upper end surface of the crank member can be raised so as to keep the front wheels of the vehicle to be inspected in the positioning recesses respectively when the front wheels are located in the positioning recesses.

Moreover, each of the slope daises is consisted of a slope dais plate arranged slantwise and a plate spring arranged horizontally, one end of the plate spring is fixed to the bottom plate and the other end thereof is fixed to a hold foot arranged at a lower end of the slope dais plate, so that the lower end of the slope dais plate is hanged in the air, a rear end of the slope dais plate is connected to one rib plate via bolts.

Additionally, the striking block has a cross section in the shape of ▽the anchoring devices each comprises a pedestal-fixed on the foundation ground and a sliding table provided on the pedestal, two anchoring blocks are symmetrically hinged in the sliding table and spaced apart from each other, each anchoring block is formed such that the striking block having a cross section in the shape of ▽can slide smoothly over the anchoring block when an outside curve of the anchoring block is contacted with the striking block, and the striking block and the anchoring block can be self-locked with each other when an inside curve of the anchoring block is contacted with the striking block, an extension spring is provided between bottom ends of the two anchoring blocks, and a mono-directional stop block is provided between the two anchoring blocks so that an outside surface of each anchoring block is tilted when the anchoring block is in its normal position, a pushing mechanism is disposed on a hinge shaft of one of anchoring blocks, the pushing mechanism can release self-locking of the striking block and the inside curve of the anchoring block.

Further, the pushing mechanism is constituted of a step motor and a linkage mechanism consisted of a pushing rod, a crank, a connecting rod and a turning lever, a power output shaft of the step motor is connected to the pushing rod which is connected to the crank hinged to the sliding table, a lower portion of the crank is hinged to one end of the connecting rod, the other end of the connecting rod is connected to a bottom end of the turning lever, an upper portion of the turning lever is fixed to a hinge shaft of the anchoring block, buffering members are each provided between transverse sides of the pedestal and the sliding table.

Preferably, the plurality pairs of guide wheels comprise four pairs of guide wheels and the plurality of auxiliary wheels comprise four pairs of auxiliary wheels, the four pairs of the guide wheels are arrayed rectangularly on the bottom surface of the frame and two guide wheels of each pair of the guide wheels are longitudinally arranged side by side on the bottom surface of the frame, four pairs of the auxiliary wheels are arrayed rectangularly and two auxiliary wheels of each pair of the auxiliary wheels are longitudinally arranged side by side.

By comparison with the trailer system in the prior art, in the trailer system for radiation imaging of the present invention, the left frame bed and the right frame-bed are flexibly connected to the H-shaped intermediate frame beam through four hinge shafts, so that forces acting on the guide wheels during movement of the wheels on the rails are even, no torque is generated, also, the trailer system for radiation imaging requires less installation accuracy of the rails. There are additionally provided detachable slope daises connected to both ends of the frame, so that it is convenient for mounting and using. Therefore, it is possible to increase greatly reliability, stability and practicability of the trailer system for radiation imaging through cooperation of the striking block on the trailer with the anchoring device fixed on the ground, so that the vehicle carrying containers can move onto or leave the trailer successfully, run stably and be locked reliably.

DETAILED DESCRIPTION OF THE PREFERRED EMBODIMENTS OF THE PRESENT INVENTION

Figure 1:
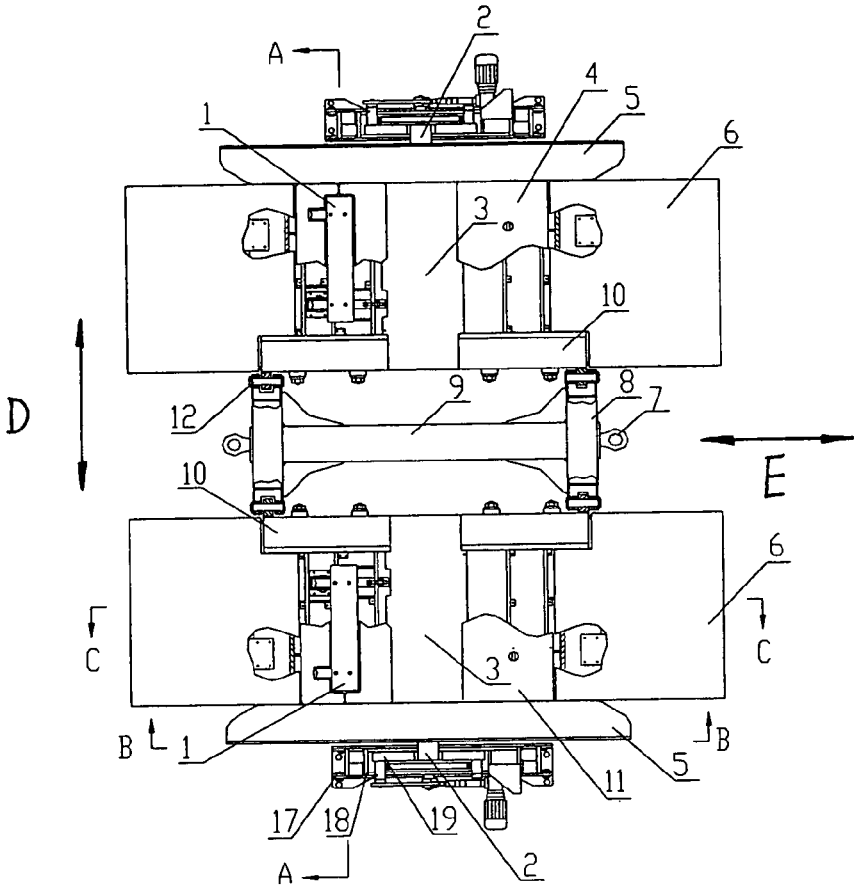
FIG. 1 is a schematic view of the structure of the trailer system according to an embodiment of the present invention.
Figure 2:
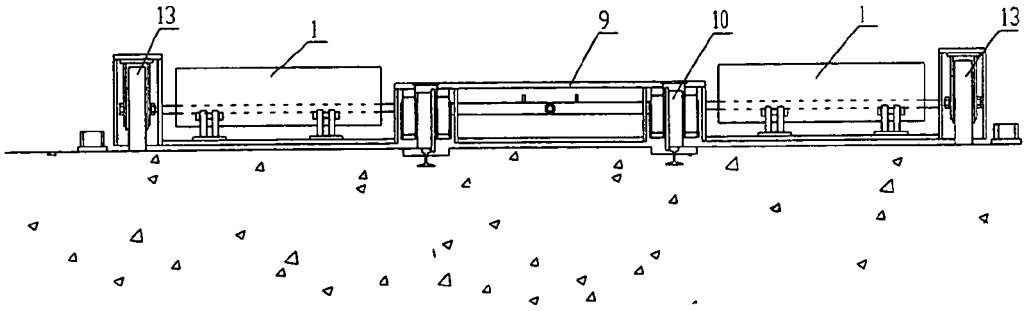
FIG. 2 is a schematic structural view taken along A—A in FIG. 1.
Figure 3:
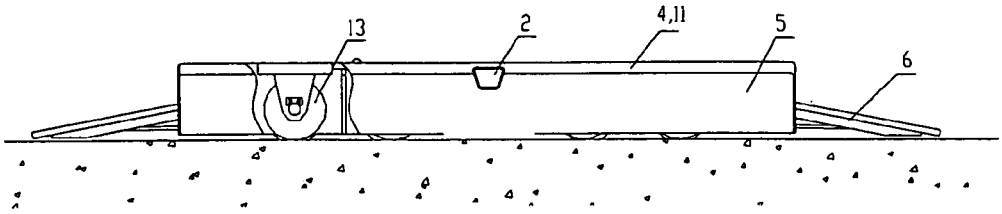
FIG. 3 is a schematic structural view taken along B—B in FIG. 1.

Preferred embodiments of the trailer system for radiation imaging according to the present invention is explained in detail with reference to the drawings.

Referring to FIGS. 1 to 6, the trailer system for radiation imaging according to the present invention comprises a trailer and anchoring devices used in cooperation with the trailer. The trailer comprises a frame 8 and four pairs of guide wheels 10, the frame 8 is constituted of a H-shaped frame beam 9, a left frame bed 4 and a right frame bed 11 which are symmetrical with respect to a central axis of the trailer transversely (in directions denoted by dual-arrow D in FIG. 1) and connected to four corners of the H-shaped frame beam 9 through hinge shafts 12, the guide wheels 10 are connected to a bottom surface of the frame 8 and can be supported and run on rails, respectively. Four pairs of the guide wheels 10 are arrayed rectangularly on the bottom surface of the frame 8, and two guide wheels of each pair of the guide wheels 10 are longitudinally (in directions denoted by dual-arrow E in FIG. 1) arranged side by side on the bottom surface of the frame 8. Two connecting hooks 7 are provided centrally on bottom portions of the front and rear ends of the H-shaped frame beam 9 respectively for connecting to wire ropes of winches. Each of the left frame bed 4 and the right frame bed 11 is constituted of a bottom plate 16, a pressing plate 14 and rib plates 15. An inside surface of each of the left frame bed 4 and the right frame bed 11 is connected to the guide wheels 10, four pairs of auxiliary wheels 13 are arranged under support plates 5 at an outside end of each of the left frame bed 4 and a right frame bed 11 respectively, the auxiliary wheels 13 are contacted with the ground or rails, the four pairs of the auxiliary wheels 13 are arrayed rectangularly in a similar way to that of the four pairs of guide wheels 10, and two auxiliary wheels of each pair of the auxiliary wheels 13 are longitudinally arranged side by side, the bottom plate 16 and the pressing plate 14 are connected by the rib plates 15 arranged vertically therebetween for reinforcing strength. A positioning recess 3 adapted to the lower portion of the wheels of the vehicle to be inspected is centrally provided in an upper surface of each of the left frame bed 4 and a right frame bed 11 respectively, a wheel-catching means 1 is provided at a rear end of the positioning recess 3 and consisted of a crank member 1—1 which can be pressed so as to be horizontal and be embedded in the pressing plate 14 and a spring 1-2, the wheel-catching means 1 is used to prevent the front wheels of the vehicle to be inspected from sliding and/or moving on the trailer. The crank member 1—1 is hinged to a side plate of one rib plate 15 at the rear end of the positioning recess 3, the spring 1-2 is fixed to the crank member 1—1 and the one rib plate 15 at both ends thereof respectively. Slope daises 6 are provided at a front end and a rear end of each of the left frame bed 4 and a right frame bed 11, the slope daises 6 are each consisted of a slope dais plate 6-1 arranged slantwise and a plate spring 6-3 arranged horizontally, the vehicle to be inspected can move onto or leave the trailer smoothly and stably through the slope daises 6. One end of the plate spring 6-3 is fixed to the bottom plate 16 and the other end thereof is fixed to a hold foot 6-2 arranged at a lower end of the slope dais plate 6-1, so that the lower end of the slope dais plate 6-1 is hanged in the air, a rear end of the slope dais plate 6-1 is connected to the one rib plate 15 via bolts. The support plate 5 is provided at the outside end of each of the left frame bed 4 and a right frame bed 11, a striking block 2 having a cross section in the shape of ▽ is provided centrally at the outside of the support plate 5, the striking block 2 is cooperated with the anchoring devices fixed on the ground so as to lock the trailer. The anchoring devices each comprises a pedestal 17 fixed on the foundation ground and a sliding table 18, two anchoring blocks 19 are symmetrically hinged in the sliding table 18 and spaced apart from each other, each anchoring block 19 is formed such that the striking block 2 having a cross section in the shape of ▽ and can slide smoothly over the anchoring block 19 when the outside curve of the anchoring block 19 is contacted with the striking block 2 and the striking block 2 and the anchoring block 19 can be self-locked with each other when the inside curve of the anchoring block 19 is contacted with the striking block 2. An extension spring 20 is provided between bottom ends of the two anchoring blocks 19, and a mono-directional stop block 23 is provided between the two anchoring blocks 19 so that an outside surface of each anchoring block 19 is tilted when the anchoring block 19 is in its normal position, a pushing mechanism 21 is disposed on the hinge shaft of one of anchoring blocks 19, the pushing mechanism 21 can release the self-locking of the striking block 2 with the inside curve of the anchoring block 19. The pushing mechanism 21 is constituted of a step motor 21-1 and a linkage mechanism consisted of a pushing rod 21-2, a crank 21-3, a connecting rod 21-4 and a turning lever 21-5, an upper portion of the turning lever 21-5 is fixed to the hinge shaft of the anchoring block 19. Buffering members 22 are each provided between transverse sides of the pedestal 17 and the sliding table 18.

Figure 4:
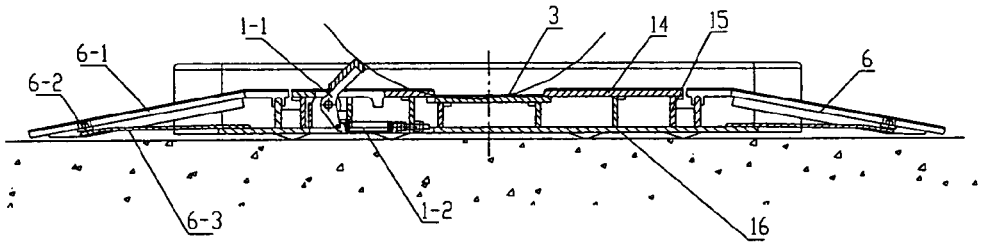
FIG. 4 is a schematic sectional view taken along C—C in FIG. 1.
Figure 5:
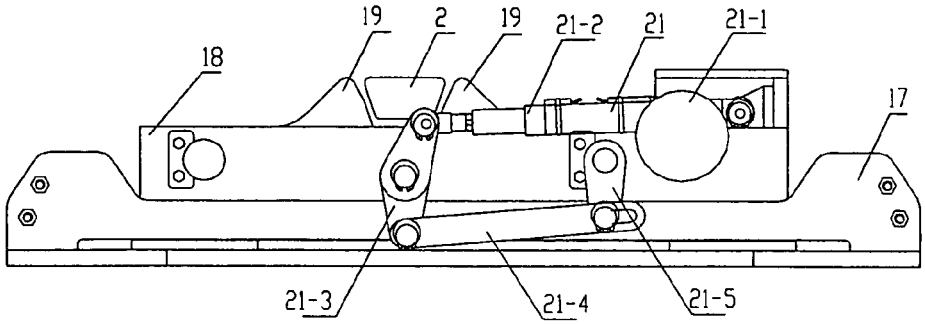
FIG. 5 is a schematic view of the structure of the anchoring device of trailer system of the present invention.
Figure 6:
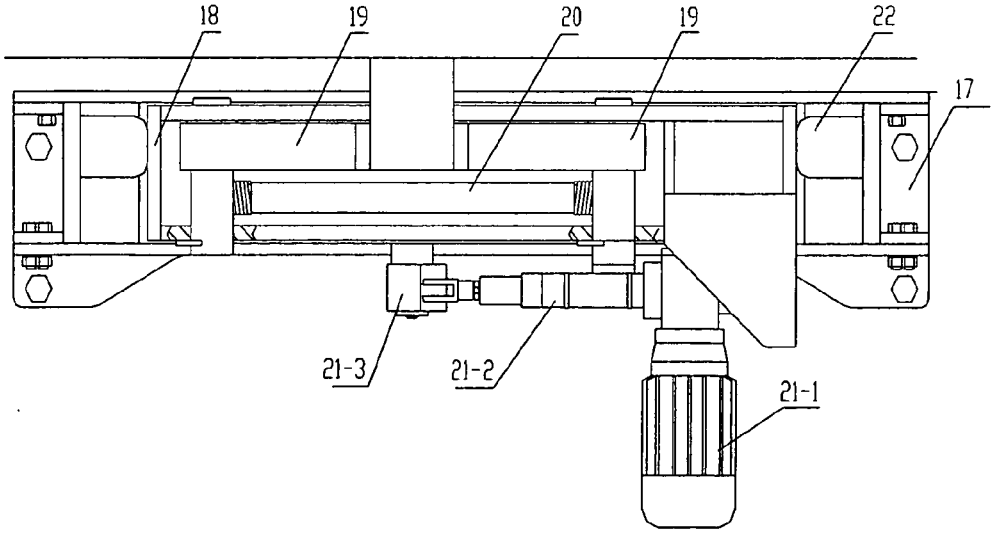
FIG. 6 is a plan view of the FIG. 5.
Figure 7:
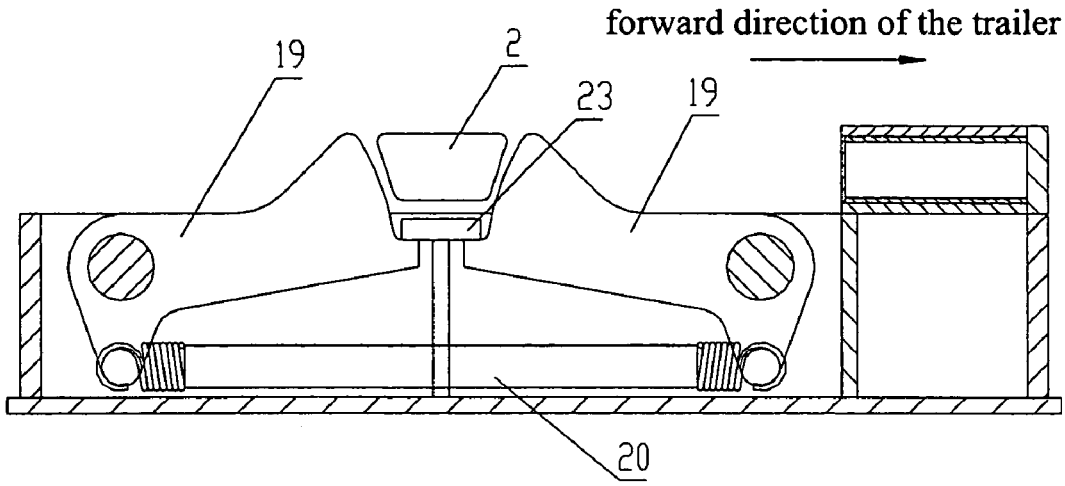
FIG. 7 is a view showing that the trailer system of the present invention is anchored in a self-locking state.

In use, the trailer is disposed in the inspection passage in which rails are arranged, the striking block 2 of the trailer is positioned at a position as shown in FIG. 1 and FIG. 7 between the two anchoring blocks 19. Winches are provided at both ends of the inspection passage respectively, and wire ropes of the winches are connected to the connecting hooks 7 on the H-shaped frame beam 9 of the trailer. The vehicle to be inspected moves onto the left frame bed 4 and the right frame bed 11 of the trailer through the upslope daises 6 provided at one end of the trailer, at this time, the striking block 2 of the trailer is in its self-locking state, so that the trailer will not be moved ahead by pushing of the vehicle to be inspected. The upper end of the crank member 1—1 is at an angle with the pressing plate 14 when the lower end of the crank member 1—1 is drawn by the spring 12, when reaching the upper end surface of the crank member 1—1, the vehicle will press down and pass the upper end surface of the crank member 1—1. Once the front wheels of the vehicle enter the corresponding positioning recesses 3, the upper end surface of the crank member 1—1 will rotate about the hinge shaft in the anticlockwise direction in FIG. 4 under drawing of the spring 1-2 so as to resist the lower rear portion of the front wheel, therefore, the vehicle to be inspected can not move rearward, as shown in FIG. 4.

Figure 8:
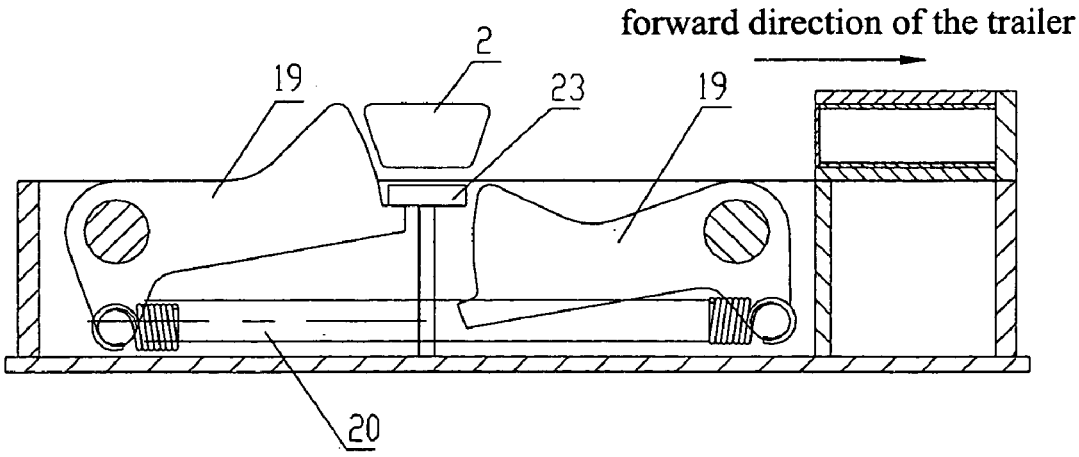
FIG. 8 is a view showing that the trailer system of the present invention is anchored in a released state.

Before the trailer moves, the step motor 21-1 is first actuated so as to move horizontally the pushing rod 21-2 leftwards, the crank 21-3 is caused to rotate by an angle in the anticlockwise direction, then the connecting rod 21-4 is pushed to move rightwards, the turning lever 21-5 is swung by an angle in the anticlockwise direction, thus causing the anchoring block 19 self-locked with the striking block to coaxially rotate by an angle, so that the anchoring blocks 19 descends, as shown in FIG. 8. At this time, the striking block 2 can pass above the anchoring blocks 19 successfully. When the trailer carrying the vehicle leaves the anchoring devices, the pushing rod 21-2 returns its initial position, since the spring 20 is pulled, the anchoring blocks 19 rotate about the hinge shafts in the clockwise direction, thereby the outside surface of each anchoring block 19 is raised until it is resisted by the mono-directional stop block 23, then the pushing mechanism 21 returns to its initial position. The anchoring devices release the striking block 2, the winch provided at one end of the inspection passage draws the trailer to move via the wire ropes connected to the corresponding connecting hook 7, so that the vehicle is carried to pass through the inspection passage smoothly and stably. When the inspection is completed, the trailer carrying the vehicle moves to the exit of the inspection passage, and glides at a decreased speed until the striking block 2 presses and moves over one anchoring block 19 of one anchoring device provided at the exit, when the striking block 2 is caught between the two anchoring blocks 19, the trailer is anchored. At this time, the vehicle on the trailer can be driven to leave the trailer through the downslope dais 6.

Thereafter, the step motor 21-1 of the anchoring device provided at the exit is actuated, one anchoring block 19 on the left side descends under the pushing mechanism 21 so as to release the striking block 2, then the trailer can be drawn inversely to the entrance of the inspection passage by the winch provided at the entrance of the inspection passage, also, the trailer glides at a decreased speed until the striking block 2 is caught between the two anchoring blocks 19 of the anchoring device provided at the entrance, thus completing one scanning process. When the vehicle moves onto or leaves the trailer, the sliding table 18 has a small impact on the pedestal 17 because of the buffering member 22, so that it is impossible to damage the anchoring device.

In addition, the two anchoring blocks 19 can be driven independently, the anchoring blocks 19 can be also driven in many manner, for example, the anchoring blocks 19 can be driven directly by a motor. Modifications including the above are all fallen into the protection scope of the present invention without departing from the spirit of the present invention whose protection scope is defined by the appended claims.

What is claimed is:

1. A trailer system for radiation imaging, comprising:

a trailer, said trailer including a frame, a plurality of pairs of guide wheels connected to a bottom surface of said frame and capable of being supported and run on rails, and connecting hooks provided centrally on bottom portions of a front end and a rear end of said frame respectively; and anchoring devices fixed to a foundation ground and used in cooperation with said trailer so as to lock said trailer at predetermined positions in use;

wherein said frame comprises an intermediate section in the form of a H-shaped frame beam, a left frame bed and a right frame bed, said left frame bed and said right frame bed are connected to said intermediate section respectively, hinge shafts are provided on four corner portions of said H-shaped frame beam and hinged to said left frame bed and said right frame bed respectively, said left frame bed and said right frame bed are symmetrical with respect to a longitudinal central axis of said intermediate section transversely, a positioning recess adapted to a lower portion of wheels of a vehicle to be inspected is provided centrally in an upper surface of each of said left frame bed and said right frame bed, a wheel-catching means is provided at a rear end of each said positioning recess for preventing said vehicle to be inspected from moving backwards on said trailer during movement of said trailer, an upslope dais and a downslope dais are provided on a front end and a rear end of each of said left frame bed and said right frame bed respectively, so that said vehicle to be inspected can move onto or leave said trailer smoothly and stably through said upslope dais and said downslope dais, a support plate is provided at an outside end of each of said left frame bed and said right frame bed, and a striking block is provided centrally at an outside of each of said support plates and used in cooperation with said anchoring devices fixed on the foundation ground so as to lock said trailer.

2. The trailer system for radiation imaging according to the claim 1, wherein each of said left frame bed and said right frame bed is constituted of a bottom plate, a pressing plate and rib plates, said guide wheels are connected to an inside surface of each of said left frame bed and said right frame bed, a plurality of auxiliary wheels are arranged under said support plate at an outside end of each of said left frame bed and said right frame bed, said bottom plate and said pressing plate are connected by said rib plates arranged vertically therebetween for reinforcing strength.

3. The trailer system for radiation imaging according to the claim 1, wherein said wheel-catching means is consisted of a crank member which can be pressed so as to be horizontal and be embedded in said pressing plate and a spring, said crank member is hinged to a side plate of one of said rib plates at the rear end of each said positioning recess, said spring is fixed to said crank member and one of said rib plates at both ends thereof respectively, an upper end surface of said crank member can be raised so as to keep front wheels of the vehicle to be inspected in said positioning recesses respectively when the front wheels are located in said positioning recesses.

4. The trailer system for radiation imaging according to any one of the claims 1–3, wherein each of said slope daises is consisted of a slope dais plate arranged slantwise and a plate spring arranged horizontally, one end of said plate spring is fixed to said bottom plate and another end thereof is fixed to a hold foot arranged at a lower end of said slope dais plate, so that the lower end of said slope dais plate is hung in the air, a rear end of said slope dais plate is connected to one of said rib plates via bolts.

5. The trailer system for radiation imaging according to the claim 4, wherein said striking block has a cross section in the shape of a trapezoid, said anchoring devices each comprise a pedestal fixed on the foundation ground and a sliding table provided on said pedestal, two of said anchoring blocks are symmetrically hinged in said sliding table and spaced apart from each other, each anchoring block is formed such that said striking block having a cross section in the shape of a trapezoid can slide smoothly over said anchoring block when an outside curve of said anchoring block is contacted with said striking block, and said striking block and said anchoring block can be self-locked with each other when an inside curve of said anchoring block is contacted with said striking block, an extension spring is provided between bottom ends of said two anchoring blocks, and a mono-directional stop block is provided between said two anchoring blocks so that an outside surface of each anchoring block is tilted when said anchoring block is in a normal position, a pushing mechanism is disposed on a hinge shaft of one of said anchoring blocks, said pushing mechanism can release self-locking of said striking block with the inside curve of said anchoring block.

6. The trailer system for radiation imaging according to the claim 5, wherein said pushing mechanism is constituted of a step motor and a linkage mechanism consisted of a pushing rod, a crank, a connecting rod and a turning lever, a power output shaft of said step motor is connected to said pushing rod which is connected to said crank hinged to said sliding table, a lower portion of said crank is hinged to one end of said connecting rod, the other end of said connecting rod is connected to a bottom end of said turning lever, an upper portion of said turning lever is fixed to a hinge shaft of said anchoring block, buffering members are each provided between transverse sides of said pedestal and said sliding table.

7. The trailer system for radiation imaging according to the claim 6, wherein said plurality of pairs of guide wheels comprise four pairs of guide wheels and a plurality of auxiliary wheels comprise four pairs of auxiliary wheels, said four pairs of the guide wheels are arrayed rectangularly on said bottom surface of said frame and two guide wheels of each pair of said guide wheels are longitudinally arranged side by side on said bottom surface of the frame, said four pairs of said auxiliary wheels are arrayed rectangularly and two auxiliary wheels of each pair of said auxiliary wheels are longitudinally arranged side by side.

* * * * *